US005603433A

United States Patent [19]

Rene

[11] Patent Number: 5,603,433

[45] Date of Patent: Feb. 18, 1997

[54] ANTI-GRAFFITI SECURITY DEVICE FOR AEROSOL DISPENSER CANS

[76] Inventor: Albert Rene, 40 Austin Ave., Amityville, N.Y. 11701

[21] Appl. No.: 429,127

[22] Filed: Apr. 26, 1995

[51] Int. Cl.[6] ..... B67D 5/33

[52] U.S. Cl. ..... 222/153.11; 222/402.11; 222/464.1; 222/504; 251/89; 251/129.2; 137/590

[58] Field of Search ..... 222/153.11, 153.13, 222/153.14, 402.11, 464.1, 504, 153.09; 239/337, 580, 583; 251/89, 129.2, 65; 137/590, 383

[56] References Cited

U.S. PATENT DOCUMENTS

| | | | |
|---|---|---|---|
| 2,892,572 | 6/1959 | Fredette et al. | 222/402.11 |
| 5,318,208 | 6/1994 | van der Wal | 222/402.13 |
| 5,385,271 | 1/1995 | Bierend et al. | 222/153 |
| 5,427,277 | 6/1995 | Bierend et al. | 222/153 |

OTHER PUBLICATIONS

"Anti–Graffiti Aerosol Spray Paint System" advertisement, *Graffiti Coalition*, Trenton, NJ, 3 pp., Oct. 1995.

Chambers, Carol, newspaper article publication, "Inventors Create Anti–Graffiti Weapon", *The Signal* newspaper, Valencia, California, Aug. 20, 1995.

*Primary Examiner*—Philippe Derakshani
*Attorney, Agent, or Firm*—Alfred M. Walker

[57] ABSTRACT

An anti-graffiti device includes a spray can with an activation base having a recess for receiving the spray can wherein the recess contains a way for controlling the dispensing flow from the spray can. The spray can has a liquid delivery tube for conducting liquid to be dispensed to an outlet and a selectively controllable interruption plunger for preventing liquid dispensing flow from the spray can. The plunger, for selectively preventing liquid flow, is independent from the finger-pressure spray can dispensing valve.

20 Claims, 14 Drawing Sheets

ANTI-GRAFFITI SECURITY DEVICE FOR AEROSOL DISPENSER CANS

FIELD OF THE INVENTION

The present invention pertains to an improved anti-graffiti security device for aerosol dispenser cans, which can render an aerosol paint can useless; without energizing an electromagnet responsive to opening and closing a delivery tube therein.

OBJECTS OF THE INVENTION

The present invention refers to an improved security device to prevent graffiti vandalism, the object of which is to render an aerosol paint spray can useless when its use is unauthorized. The device includes a pivotable plunger unit responsive to the energization of a magnet, such as an electromagnet. The device is attachable to a wall outlet by way of a transformer connected through 110 volt wire plug, by which the electromagnet is energized.

SUMMARY OF THE INVENTION

The anti-graffiti device of the present invention provides a novel solution to problems presently existing in the aerosol spray paint industry. Vandalism in the form of graffiti defacement of walls of buildings, vehicles and other structures is widespread. There is therefore a long felt need to incorporate a control device which can prevent a vandal from unauthorized use of a spray can of paint, to render the device useless, unless authorized.

Therefore, the present invention includes an aerosol spray can with an activation base having a recess for receiving the spray can wherein the recess contains means for controlling the dispensing flow from the spray can.

The spray can has a liquid delivery tube for conducting liquid to be dispensed to an outlet and a selectively controllable interruption means for preventing liquid dispensing flow from the spray can.

The means for selectively preventing liquid flow of paint is independent from the finger-pressure spray can dispensing valve.

The activation base has an electromagnet operated by appropriate electric current, such as specifically 110 volts or 220 volts, and a recess for receiving the spray can therein.

By limiting the current to only high voltage, such as 110 or 220 volts, the anti-graffiti device cannot be rendered operative by an unauthorized user, such as a vandal, using a lower voltage power source, such as a 12 volt battery.

The spray can has a liquid delivery tube for conducting liquid to be dispensed to an outlet, and the spray can has a bottom member, the bottom member being made of a suitable non-magnetic material and an inner plunger unit of a suitable magnetic material, such as ferrous metal. The plunger unit moves away from the delivery tube and toward the interruption means, which includes an electromagnetic apparatus capable of moving the plunger unit away from the delivery tube. The electric current for the electromagnetic apparatus must be conventional household current, used residentially or commercially, such as 110 Volt 60 cycle alternating current, or alternatively, 220 volt current.

The plunger unit of the liquid flow interruption means includes a valve disposed inside the aerosol spray can which is capable of movement between an open position and a closed position.

The activation base includes a bore for a fastener, such as a locking screw or knurled locking screw, wherein the fastener securely retains the aerosol spray can within an activation base recess therein, such as a locking screw, and the activation base is further provided with an electrical supply cord having electrical cord strain prevention means, a plug means and electrical switch means.

The valve, capable of moving between an open and a closed position includes a plunger mounted to a spring plate and a pilot guiding member attached to one free end of the spring plate, wherein the spring plate, plunger and pilot member are contiguous, and wherein the spring plate is made of a suitable magnetic material, such as ferrous metal.

The plunger retains the liquid within the aerosol container and acts as a flow interruption means within the spray can near and/or substantially within the spray can bottom member.

The spray interruption means includes the spring plate of a suitable magnetic material, and the delivery tube further has a plunger channel passing therethrough.

The flow interruption valve includes the spring plate which is further moveably retained within the aerosol container and the spring plate acts as a spring for urging the flow interruption valve into the closed position.

The pilot extension member at the force end of the ferrous metal spring plate is insertable within the spray can liquid delivery tube and is capable of slidably moving within the delivery tube.

The pilot member guides the plunger into effectively sealing contact with the delivery tube when the flow interruption valve is in the closed position.

The electromagnet is disposed in an effective positional relationship to the plate so as to selectively and magnetically draw the end plate in a motion against its resistance to move from the delivery tube to move the flow interruption valve between the closed position and the open position.

Preferably the spring plate is comprised of two portions, one a non-magnetic portion attached to a suitable magnetic material, since only a small portion of the spring plate needs to be energized by the electromagnet for urging the plunger into effective sealing contact with the delivery tube of the aerosol spray can.

Preferably also a bumper is disposed between the spring plate and the spray can bottom member so as to cushion impact therebetween.

The plunger may be a cone for insertion into and sealing of the spray can liquid delivery tube. The spring plate is affixed near and/or substantially upon the bottom member of the spray can, wherein the bottom member is made of a non-magnetic material, such as aluminum, so that the magnetic field may penetrate into the aerosol spray can in the vicinity of the magnetic spring plate.

In another alternate embodiment, the aerosol spray can may be provided with an activation exterior collar for selectively interrupting and/or controlling the dispensing of can contents.

The alternative activation collar is disposed on the spray can exterior, and the activation collar also includes an electromagnet operated by electric current and a means to prevent tampering with the activation collar.

Generally, an aerosol spray can has a dispensing valve operated by pressure from the finger of a user, wherein finger pressure causes the Valve to move from the closed to the open position for dispensing can contents through a delivery tube communicating with the dispensing value. To selectively inactivate its use, the spray can has the interruption means for selectively preventing dispensing of contents thereof.

The liquid flow interruption means may be an interlock disposed within the activation collar for selectively locking the finger pressure dispensing valve of the spray can in the closed position.

The activation collar dispensing interlock further comprises a movable lock member comprised of a suitable magnetic material. The lock member moves between a locked and an unlocked position. The spring urges the lock member into the locked position, wherein the finger pressure dispensing valve of the spray can is thereby locked in the closed position, wherein to prevent its unauthorized use by vandals.

In general, whether the electromagnet is disposed within an activation base or within an exterior collar, the electromagnet is positioned so as to draw the lock member in a motion against the urging of the spring. The electromagnet thus provides a magnetic force for moving the lock member into its unlocked position and maintaining it there.

The electromagnet unit is further provided with an electrical supply cord having an electrical cord strain prevention means, a plug and an electrical switch means.

To prevent tampering of the embodiment with an exterior collar, a tamper prevention means includes a pinhole in the aerosol spray can which has a flexible sealing gasket therearound. The gasket is unfixed and free to become dislodged, when tampered and the gasket is held in sealing disposition over the spray can pinhole.

The lockout yoke is installed so that any attempt to remove or damage the lockout yoke results in the depressurization of the can. Therefore, the can may be manufactured with a pin hole with a seal.

Any attempt to remove the lockout yoke results in the breaking-off of the unit and the exposure of the can to the pin hole with a seal means, so that puncturing produces a pin hole to eliminate the aerosol pressure within the aerosol can.

DESCRIPTION OF THE DRAWINGS

In order to clarify the description that is being given of the present invention, and with the object of facilitating better comprehension of the features of the present invention, enclosed along with and as an integral part of the specification, are the following drawing figures, in which, with illustrative and non-limitative character, the following is represented.

DETAILED DESCRIPTION OF THE DRAWINGS

Figure 1:
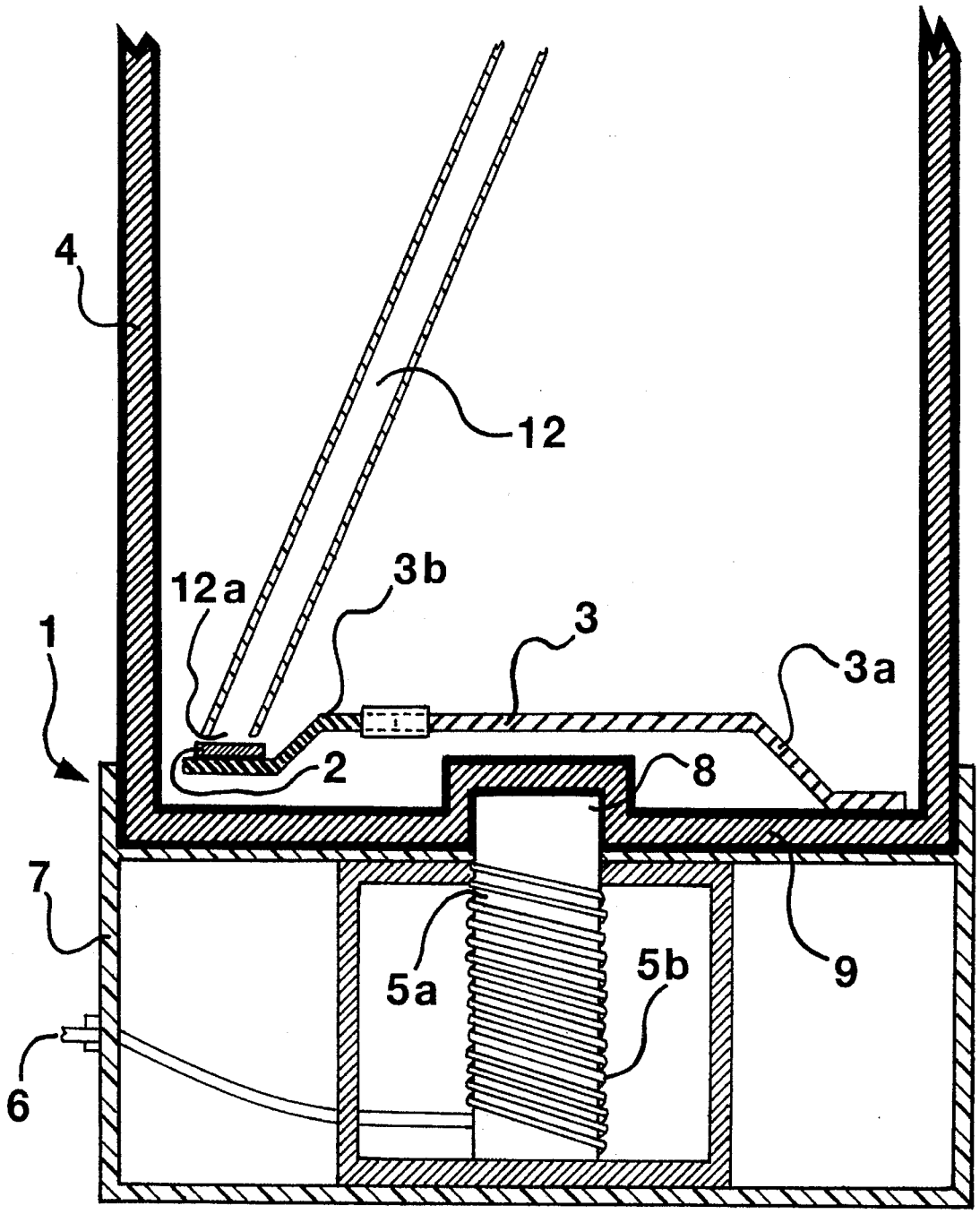
FIG. 1 shows a close-up side sectional view of the spring means of the anti-graffiti device of the present invention, shown in a closed position.
Figure 2:
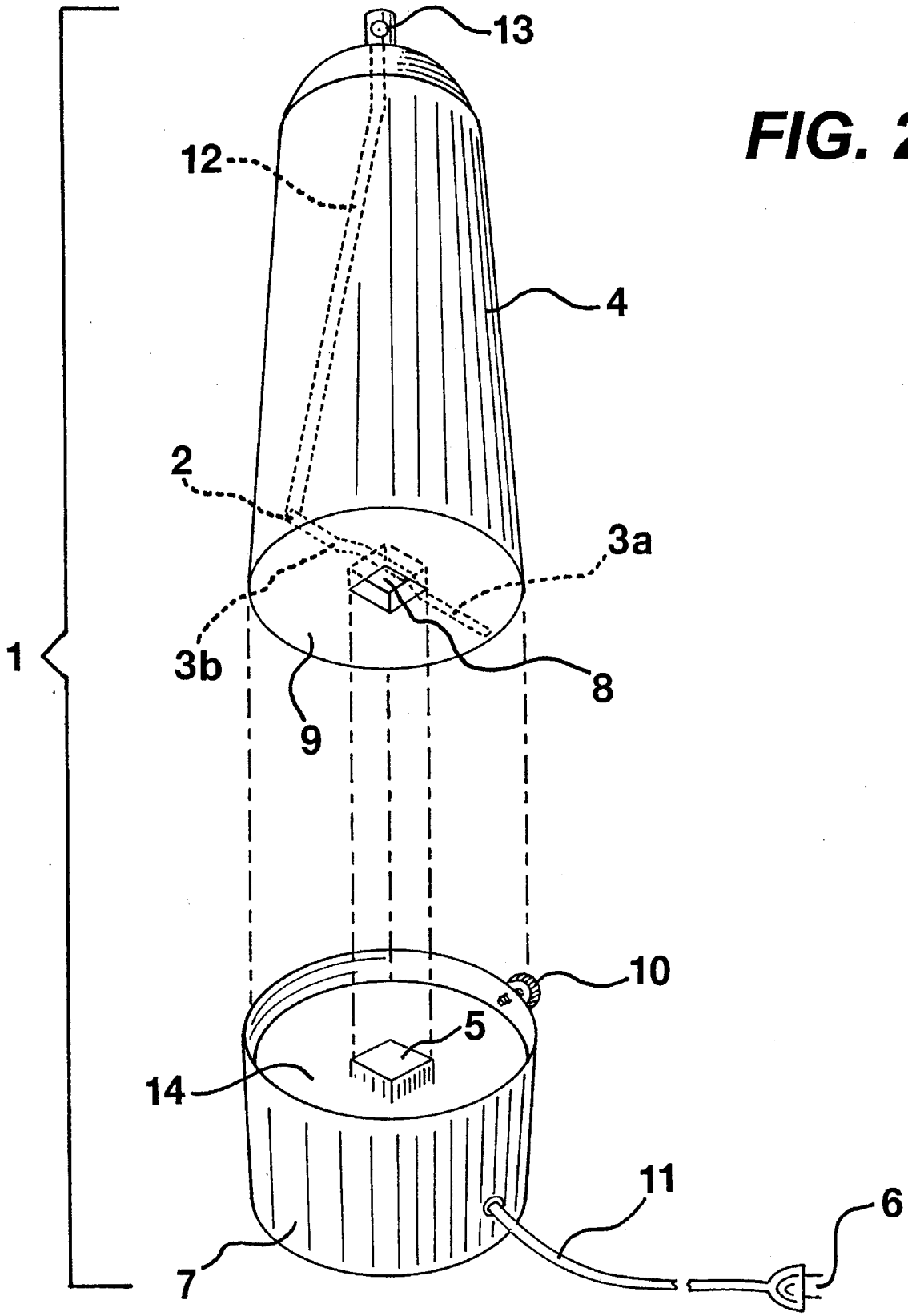
FIG. 2 shows a perspective view of the anti-graffiti device as shown in FIG. 1.
Figure 3:
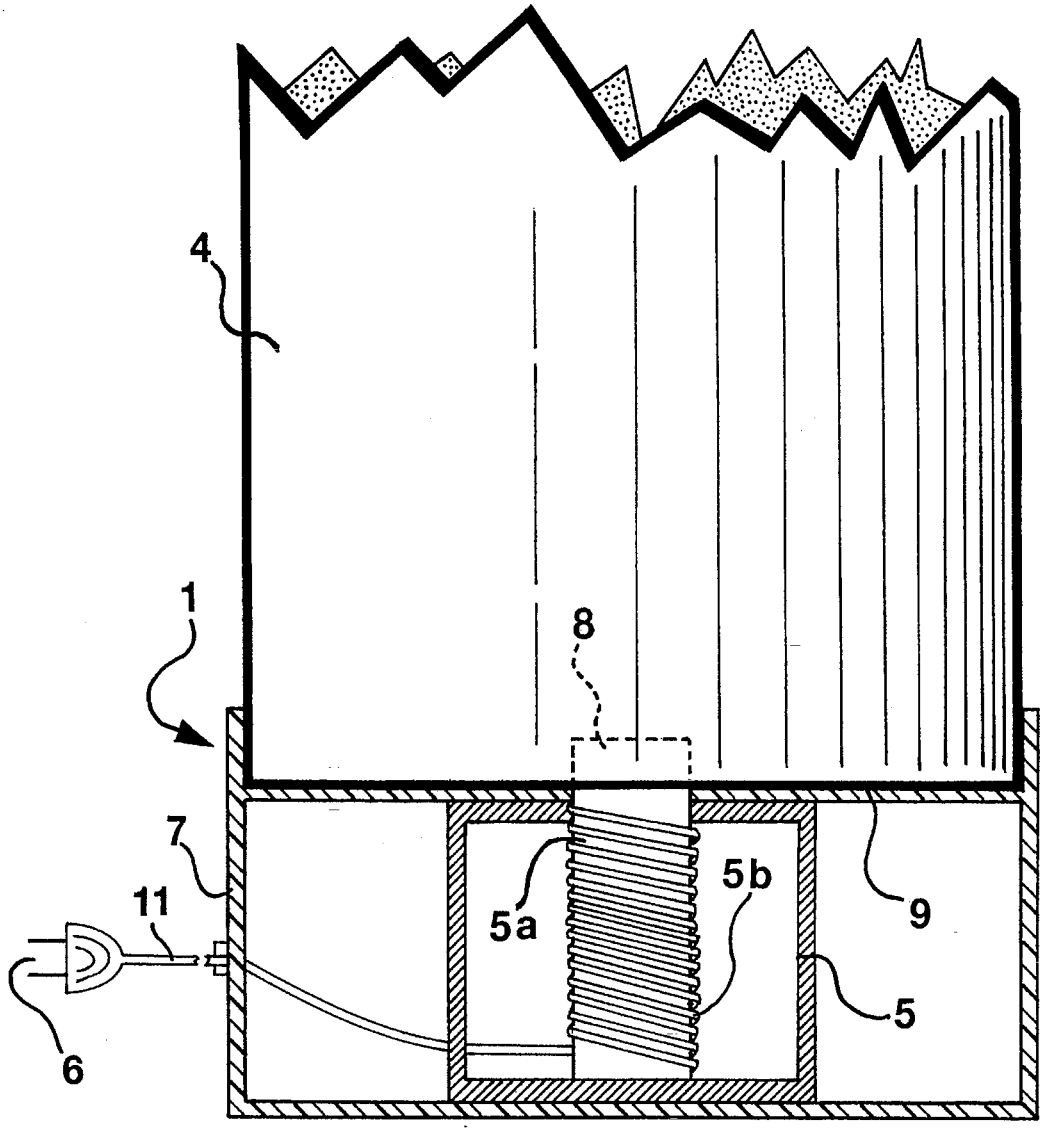
FIG. 3 shows a side elevational view in partial section of the anti-graffiti device as in FIG. 1.
Figure 4:
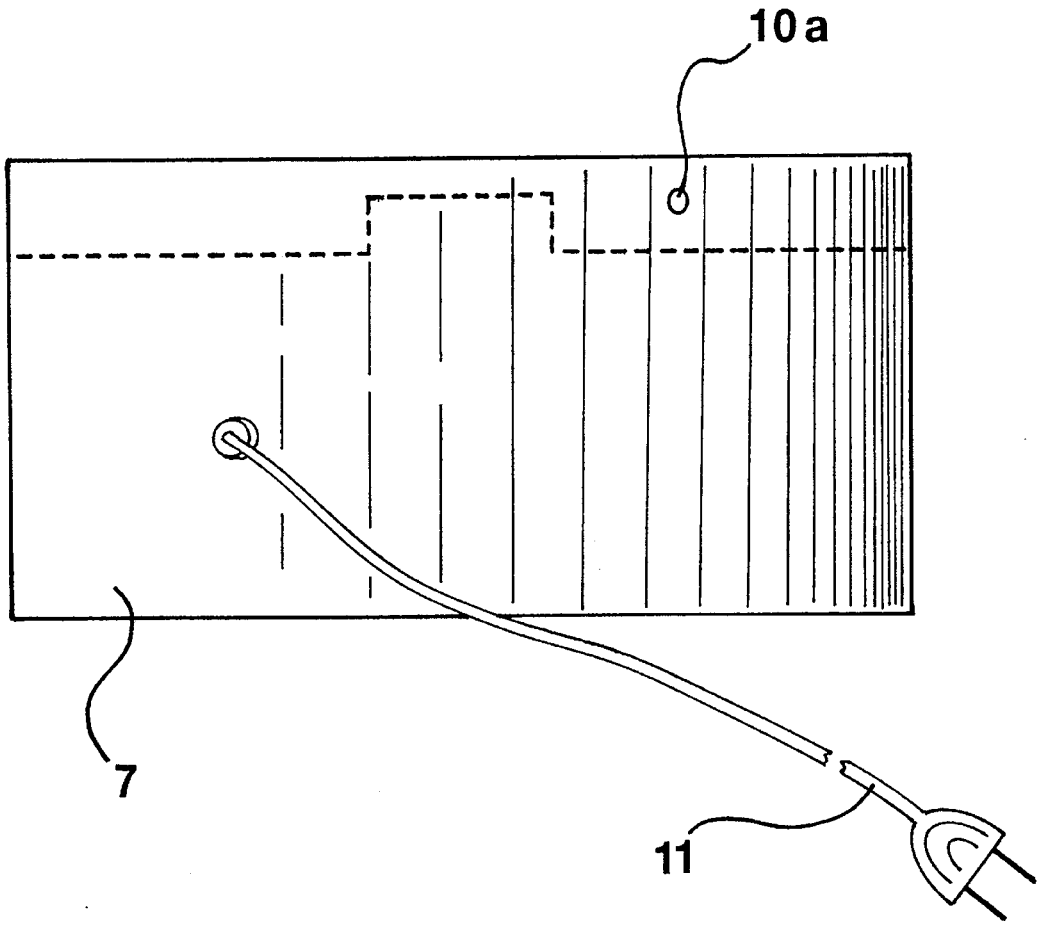
FIG. 4 shows a side elevational view of the improved anti-graffiti device as in FIG. 1.
Figure 5:
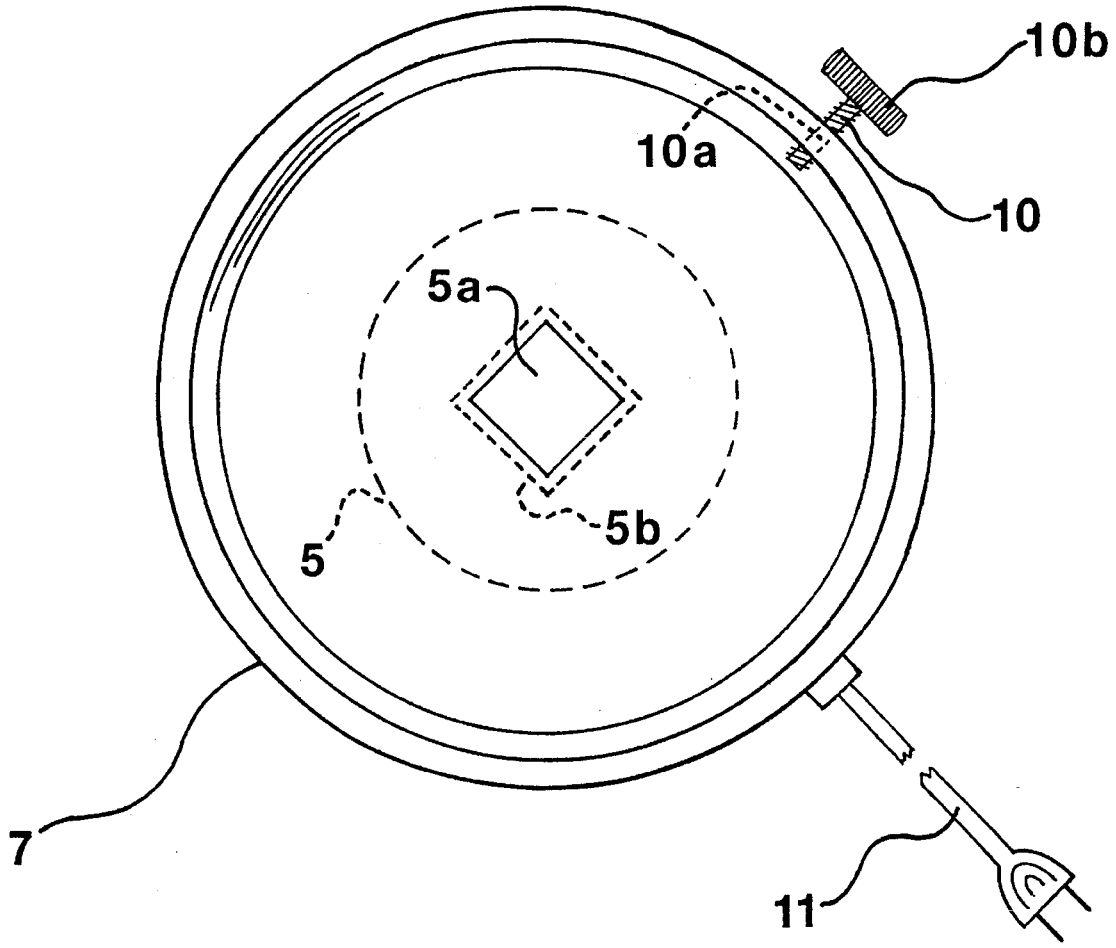
FIG. 5 is a top plan view of the base portion of the anti-graffiti device as in FIG. 1.
Figure 6:
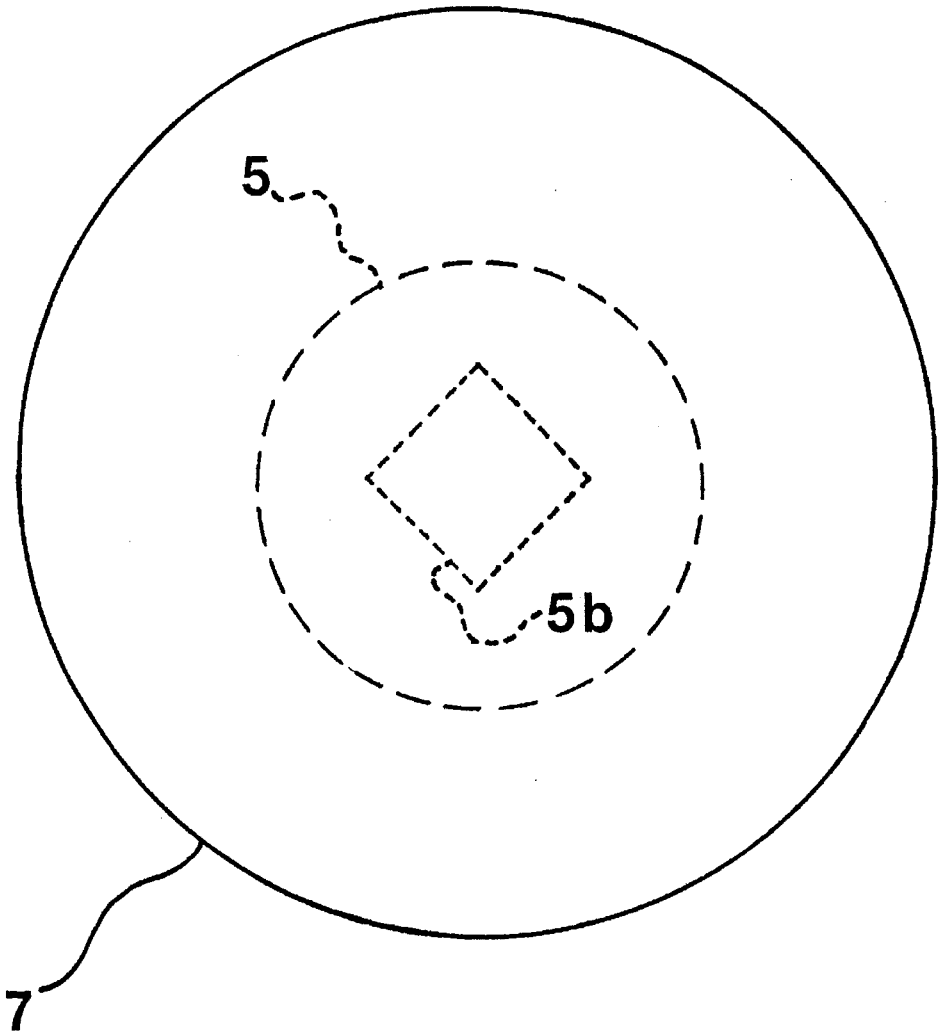
FIG. 6 is a bottom view of the base portion of the anti-graffiti device as in FIG. 1.

As shown in FIGS. 1–6, the present invention includes an anti-graffiti device 1 for selectively disabling or activating an aerosol paint spray can 4.

Spray can 4 must be used while attached to an activation base 7 by a fastener, such as locking screw 10, so that a 110 volt or 220 volt current can be applied to an electromagnet 5 within activation base 7 for moving a plunger 2 contiguous to a metallic spring 3 away from an intake end 12*a* of delivery tube 12.

A complete seal of delivery tube 12 by plunger 2 is not required to make spray can 4 inoperable because a partial obstruction of intake end 12*a* of delivery tube 12 is sufficient to allow enough reduction in aerosol pressure within spray can 4 to impede the flow of liquid spray paint through delivery tube 13 and out of finger operable outlet valve 12. Therefore, plunger 2 needs only to block as little as twenty percent of intake 12*a* of delivery tube 12 to impede aerosol pressure within spray can 4 sufficient for preventing delivery of spray paint therethrough.

Plunger 2 is preferably a non-metallic substance, such as plastic, to prevent activation by a permanent magnet placed in the vicinity of plunger 2.

Anti-graffiti device 1 includes modifications to spray can 4 including shut-off plunger 2 attached to metallic spring plate 3 to render the spray can 4 inoperable, when plunger 2 blocks liquid paint from entering delivery tube 12 of spray can 4, as noted above.

Plunger 2 is withdrawn from delivery tube 12 when an electromagnetic field, derived from an electromagnet unit 5 pulls metallic spring plate 3 and plunger 2 away from a bottom opening intake end 12*a* of delivery tube 12.

Electromagnetic unit 5 is attached to a 110 volt source 6 intake end 12*a* is applied to spray can 4 after being seated in activation base 7 containing electromagnet unit 5 therein. Magnetic core 5*a* of electromagnetic unit 5, is energized by magnetic coil 5*b* which is placed adjacent to and around magnetic core 5*a* within electromagnetic unit 5.

To place the electromagnetic core 5*a* in close proximity to spring plate 3, electromagnetic core 5*a* is inserted within recess 8 within bottom 9 of spray can 4.

The spray can 4, is secured in the activation base 7 by turning locking knob 10*b* of locking screw 10 within bore 10*a* of base 7.

Power is supplied in 110 volt or 220 volt, current through power cord 11, which energizes the electromagnet 5. This causes the spring plate 3, such as steel, to be attracted to the electromagnet 5, and in so doing, partially retracts the sealing plunger 2, until it moves toward the aluminum bottom wall 9 of the spray can 4. The aerosol paint within can 4 can then be drawn up through delivery tube 12, and out of the nozzle 13 of spray can 4.

A typical electromagnet 5 is such as manufactured by MCI Transformer of North Babylon, N.Y., although many other appropriate electromagnets may be used. Electromagnetic coil **5*b* within electromagnet 5** has a two inch outer diameter and an inside diameter of 0.778 inch. The coil draws 10 lbs. pull when subject to 110 volt electric current at 2 amp. It has a 10,000 hour useful life and a weight of 1¼ lbs.

Aerosol spray can 4 is inserted within electromagnetically operated base 7 for controlling the dispensing flow from the spray can 4 of a liquid for opaque marking, such as spray paint.

Activation base 7 includes recess 14 for receiving the spray can 4.

Spray can 4 includes liquid delivery tube 12 for conducting liquid to be dispensed to an outlet valve 13 atop spray can 4, and spray can 4 further has bottom member 9, wherein bottom member 9 is made of a suitable non-magnetic material, such as aluminum.

Activation base 7 further has electromagnet 5, which electromagnet 5 is operated by electric current from power source 6 through cord 11.

Spray can 4 has liquid control plunger valve 2, wherein liquid control plunger valve 2 has an open position and a closed position for passage of liquid, such as spray paint, therethrough.

Plunger 2 is connected to a free end of spring plate 3, wherein the spring plate 3 is made partially of a suitable magnetic material **3*a* and optionally a non-magnetic portion 3*b***, such as plastic.

Figure 7:
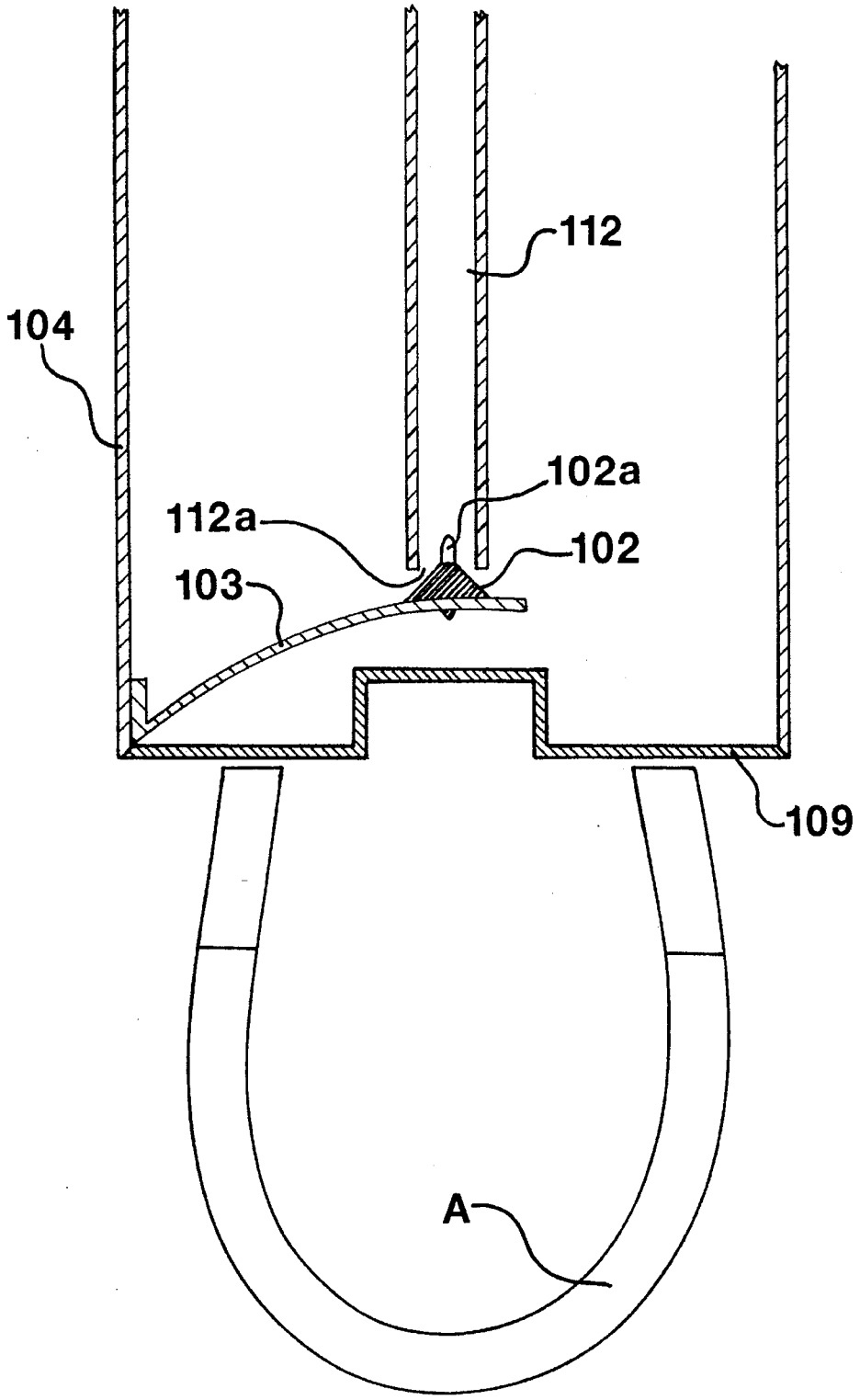
FIG. 7 is a close-up view of an alternate spring plate in an alternate embodiment for an anti-graffiti device.
Figure 8:
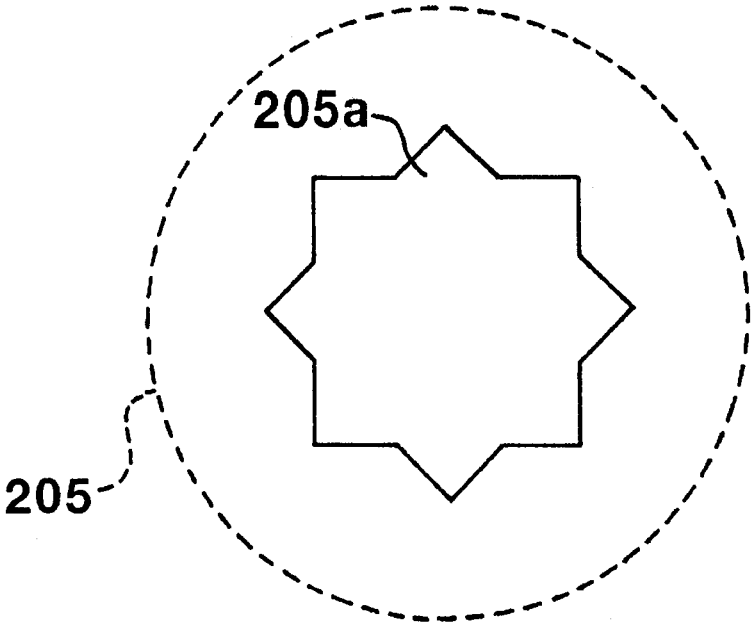
FIG. 8 is a top plan view of an alternate electromagnetic protrusion unit.

Optionally, as shown in FIGS. 7 and 8, a pilot extension member **102*a* is connected to plunger 102 and spring plate 103 of aerosol can 104, and pilot extension member 102*a* is inserted within the spray can liquid delivery tube 112 and is capable of moving within the liquid delivery tube 112**.

Spray can 104 may be activated while attached to an activation base by a fastener, so that a 110 volt or 220 volt current can be applied to an electromagnet within the activation base so as to move a plunger 102 contiguous to a metallic spring 103 away from an intake end **112*a* of delivery tube 112**.

Pilot member **102*a* guides plunger 102 into a partial contact with the delivery tube 112 when the liquid control plunger 102** moves from the open to the closed position.

An activation base is provided with an electromagnet, for magnetically drawing the control valve plunger 102 and spring plate 103 downward against the resistance of spring plate 103, thereby moving the control valve plunger 102 from the closed position to the open position to permit liquid flow through delivery tube 112.

FIG. 7 also shows a conventional permanent magnet A in an unauthorized position in an attempt to bypass the locking features of the present invention. It is known that both poles of a permanent magnet must generally be positioned within one half (½) inch of a metallic or magnetically attractable object sought to be attracted to permanent magnet A. Therefore, metallic spray plate 103 is placed such that a portion of spring plate 103 is within one half (½) inch of the magnetic core of electromagnet. Therefore, both poles of an permanent magnet A cannot be placed close enough to spring plate 103 to override the anti-graffiti means of spray can 104.

It is noted that the same principle applies to the preferred embodiment shown in FIGS. 1–6 wherein magnetic portion **3*a* of spring plate 3 is placed within one half (½) inch of magnetic core 5*a***.

Figure 8A:
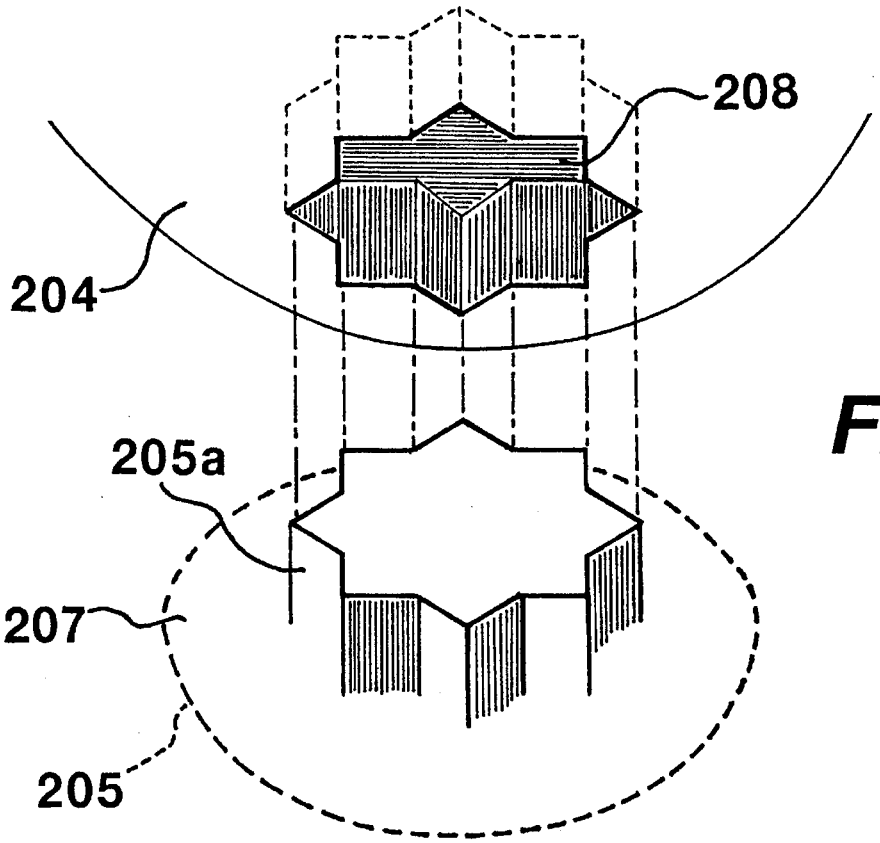
FIG. 8A is a perspective view of the alternate electromagnetic protrusion unit shown in FIG. 8.

As shown in FIGS. 8 and 8A, an alternate irregularly shaped electromagnetic core **205*a* to electromagnet 205 within base 207 may be insertable within a recess 208 of spray can 204 with a corresponding irregular shape. The corresponding irregular shapes of core 205*a* and recess 208 provide an extra protection against tampering, by not allowing a conventional magnet to be inserted therein to activate a shutoff restriction valve, such as spring 3 attached to plunger 2 shown in FIGS. 1–6, which spring 3 and plunger 2 restrict the flow of liquid spray paint through intake end 12*a* of delivery tube 12 of spray can 4**.

Figure 9:
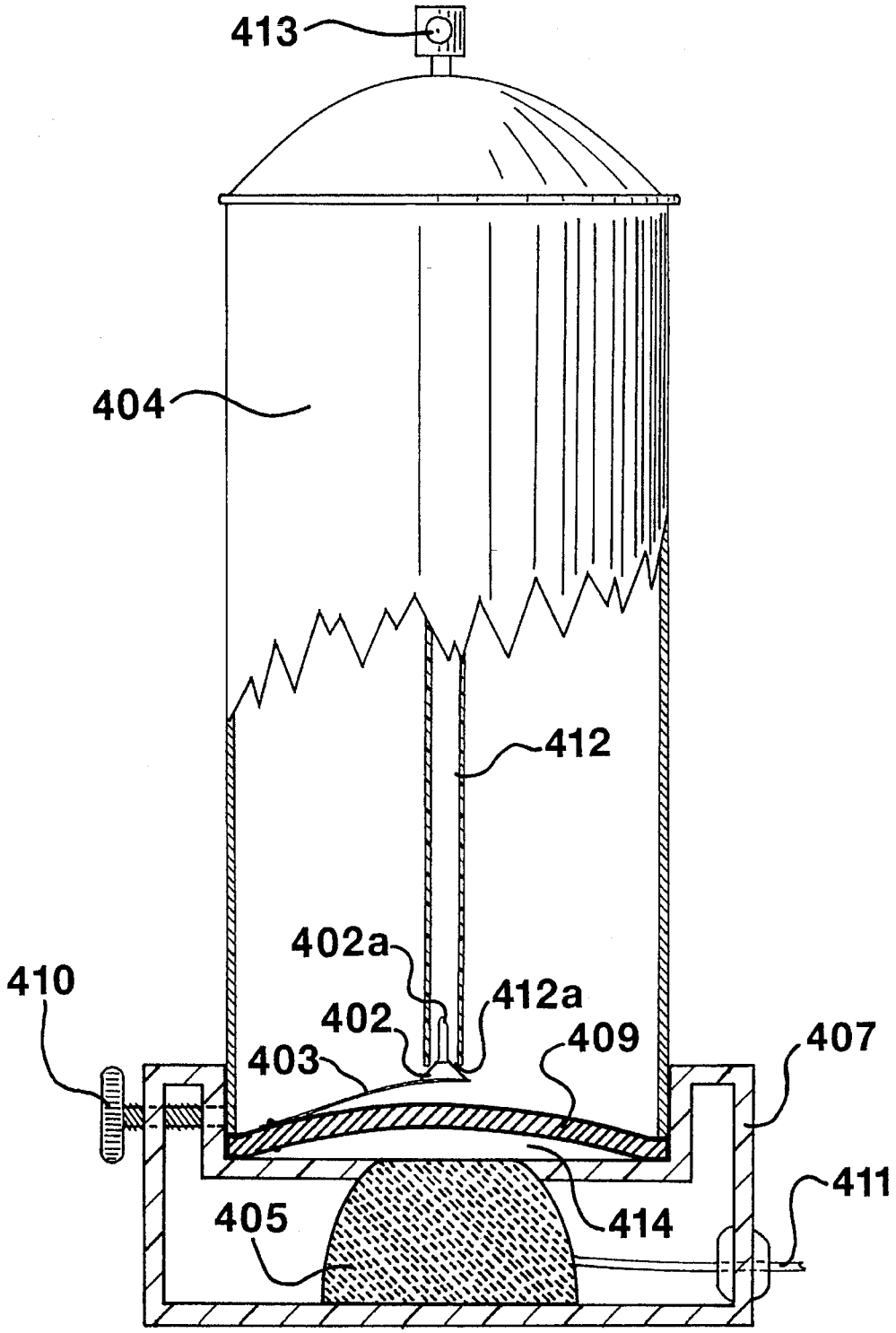
FIG. 9 is a side elevational view in partial section of a second alternate embodiment of an anti-graffiti device.
Figure 10:
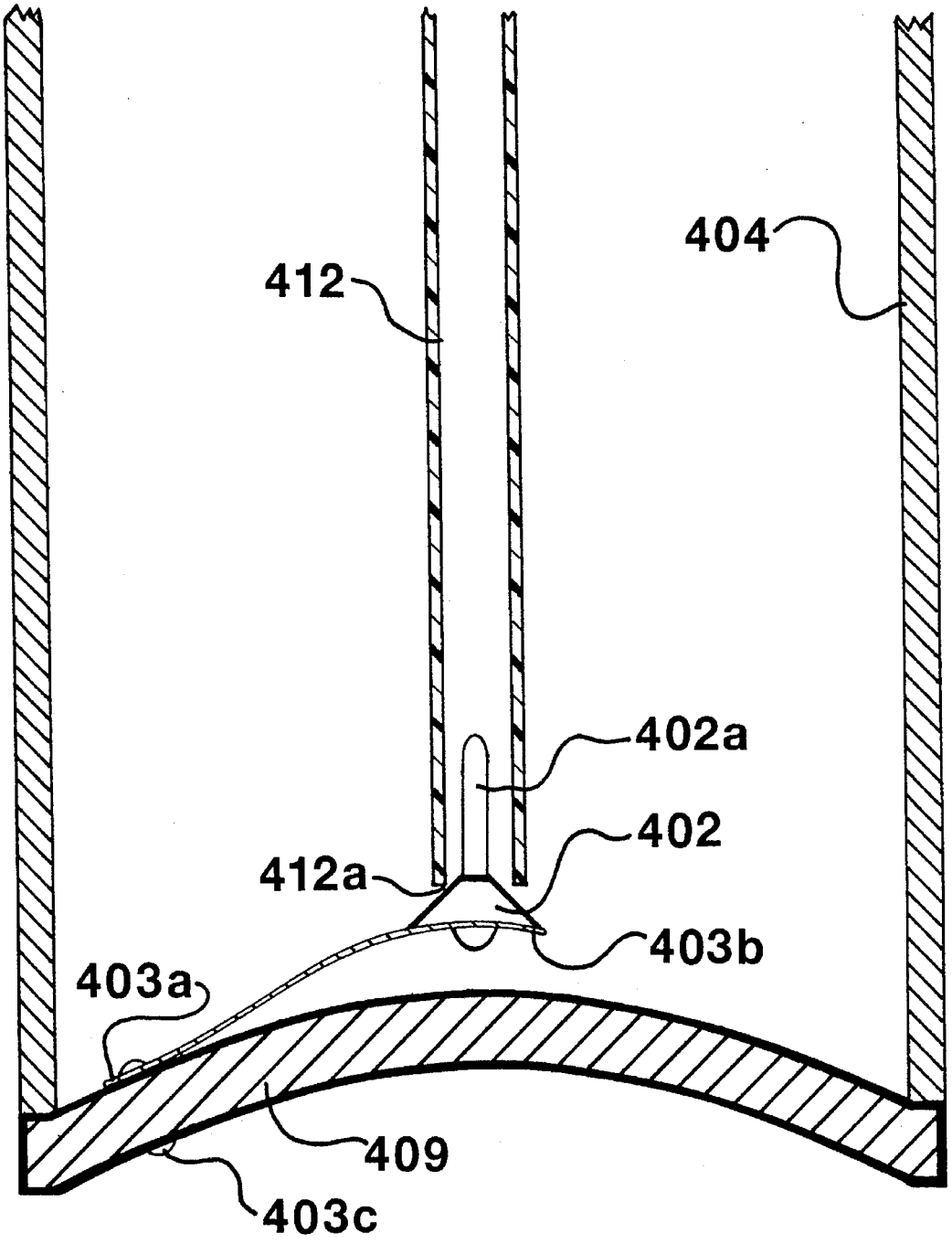
FIG. 10 is a close-up side sectional view of the anti-graffiti device as in FIG. 9, shown in a closed, inoperable position.
Figure 11:
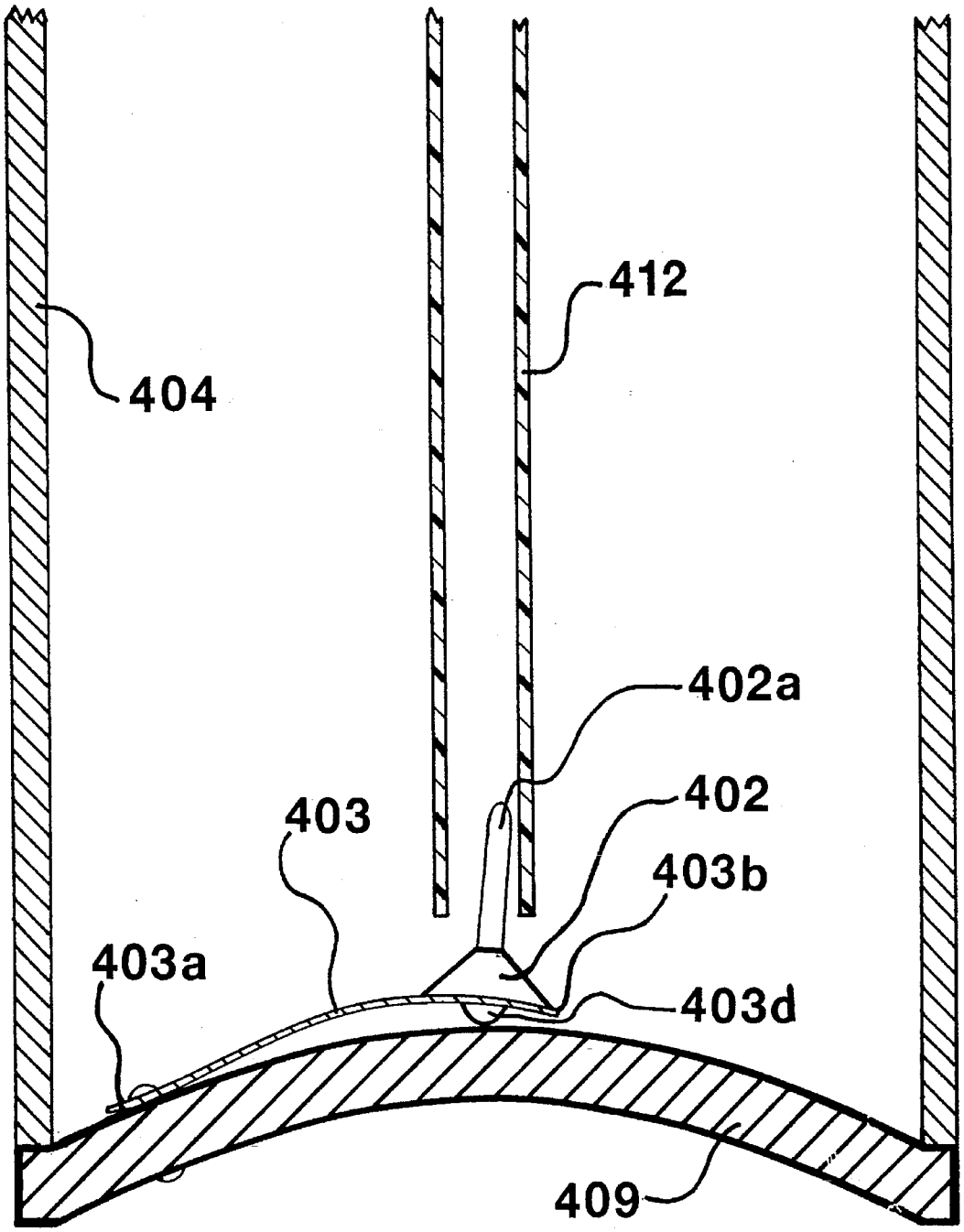
FIG. 11 is a close-up side sectional view of the anti-graffiti device as in FIG. 9, shown in an open, operable position.

As shown in FIGS. 9–11, electromagnet 405 can be alternately placed near to a conventional concave bottom 409 of spray can 404.

Spray can 404 must also be used while attached to an activation base 407 by a fastener, such as locking screw 410, so that a 110 volt or 220 volt current can be applied to an electromagnet 405 within activation base 407 for moving a plunger 402 contiguous to a metallic spring 403 away from an intake end **412*a* of delivery tube 412**.

As further shown in FIGS. 9–11, spray can 404 is insertable with electromagnetically operated base 407 for controlling the dispensing flow from the spray can 404 of a liquid for opaque marking, such as spray paint.

Activation base 407 has a recess 414 for receiving the spray can 404 therein.

Spray can 404 has a liquid delivery tube 412 for conducting liquid to be dispensed to an outlet 413 and spray can 404 further has a concave bottom member 409, wherein bottom member 409 is made of a suitable non-magnetic material. Metallic spring plate 403 is attached at a proximal end **403*a* to bottom member 409 by fastener 403*c***, such as a rivet or tack weld.

Spray can 404 has a liquid control plunger valve 402 wherein the liquid control plunger valve 402 has an open position and a closed position.

Control valve plunger 402 is attached to spring plate 403 and pilot member **402*a* at distal end 403*b* of spring plate 403, wherein spring plate 403, plunger 402 and pilot member 402*a* are contiguous, and wherein spring plate 403** is made of a suitable magnetic material.

Pilot extension member **402*a* is inserted within the spray can liquid delivery tube 412 to move within the liquid delivery tube 412**.

Pilot member guides plunger 402 into a partial contact with the delivery tube 412 when plunger 402 moves from the open to the closed position.

Activation base 407 is provided with an electromagnet 405, for magnetically drawing the control plunger valve 402 and spring plate 403 downward against the resistance of spring plate 403, and thereby moving the control plunger valve 402 from the closed position to the open position. Power is supplied through power cord 411 to electromagnet 405. Bumper member **403*d* may be applied to an underside of spring plate 403 where plate 403 contacts an upper surface of bottom member 409**.

Figure 12:
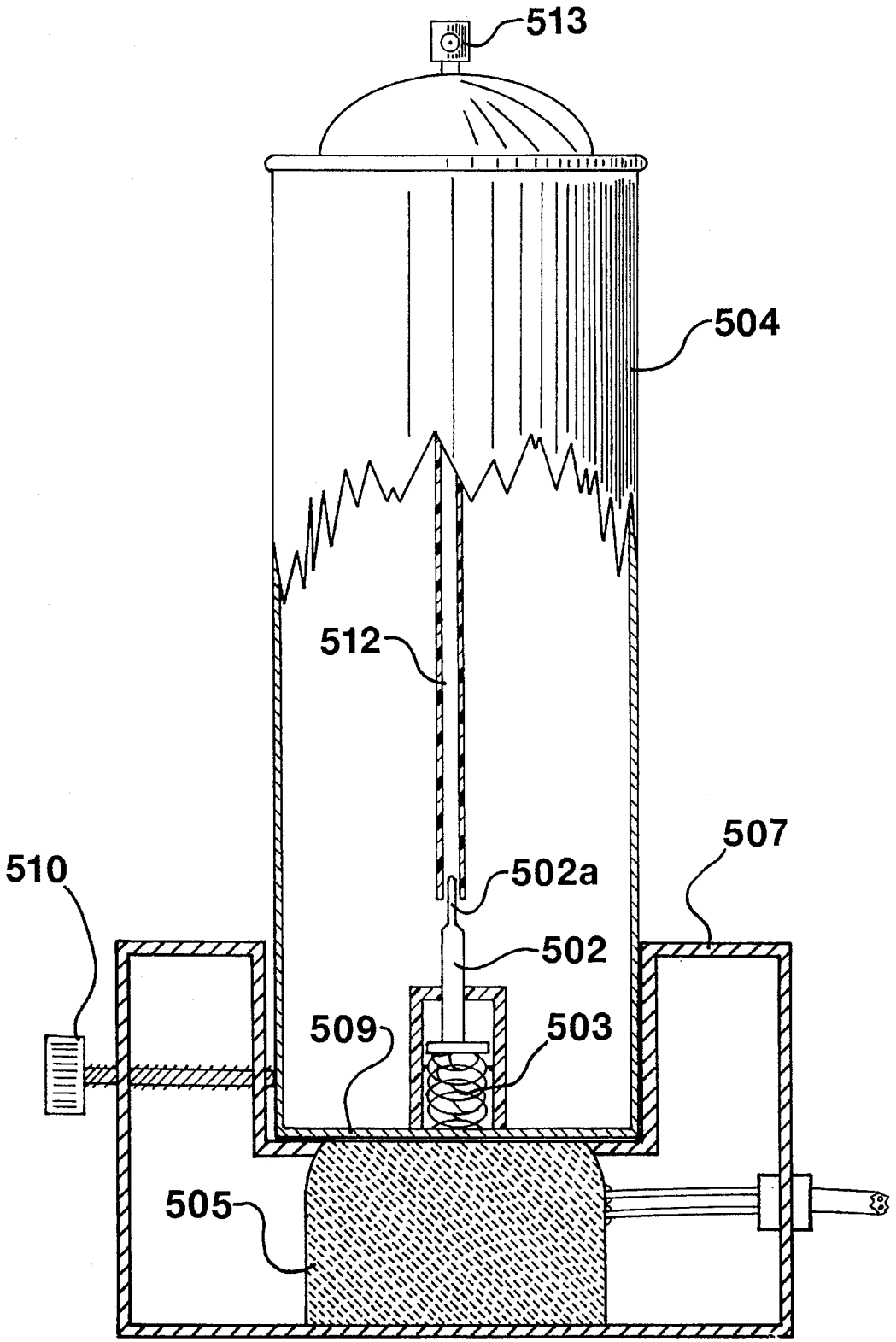
FIG. 12 is a side elevational view in partial section of a third further alternative embodiment for an anti-graffiti device.

As shown in FIG. 12, spring 503 may be a metallic coil spring below plunger member 502 attached to guide member **502*a*, insertable within delivery tube 512 of spring can 504** to prevent fluid flow out of delivery tube 512 and outlet valve 513. Coil spring 503 is energized by electromagnet 505 adjacent to bottom member 509 of spray can 504, which is held in place with base 507 by locking member 510.

Spray can 504 must also be used while attached to an activation base 507 so that a 110 volt or 220 volt current can be applied to an electromagnet 305 within activation base 507 for moving a plunger 502 contiguous to a metallic coil spring 503 away from delivery tube 512.

Figure 13:
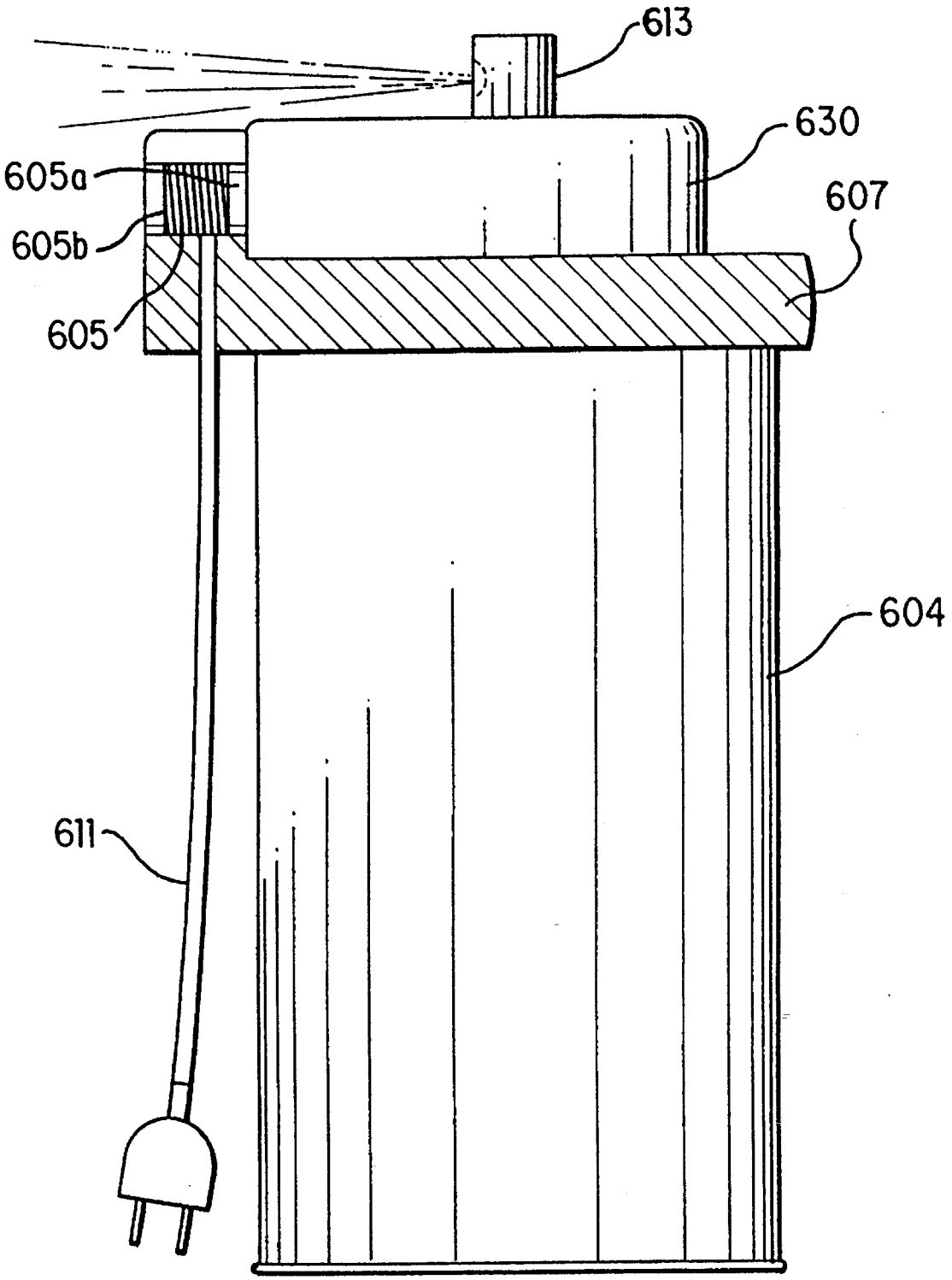
FIG. 13 is a side elevational view in partial section of a fourth, further alternative embodiment for an anti-graffiti device.
Figure 14:
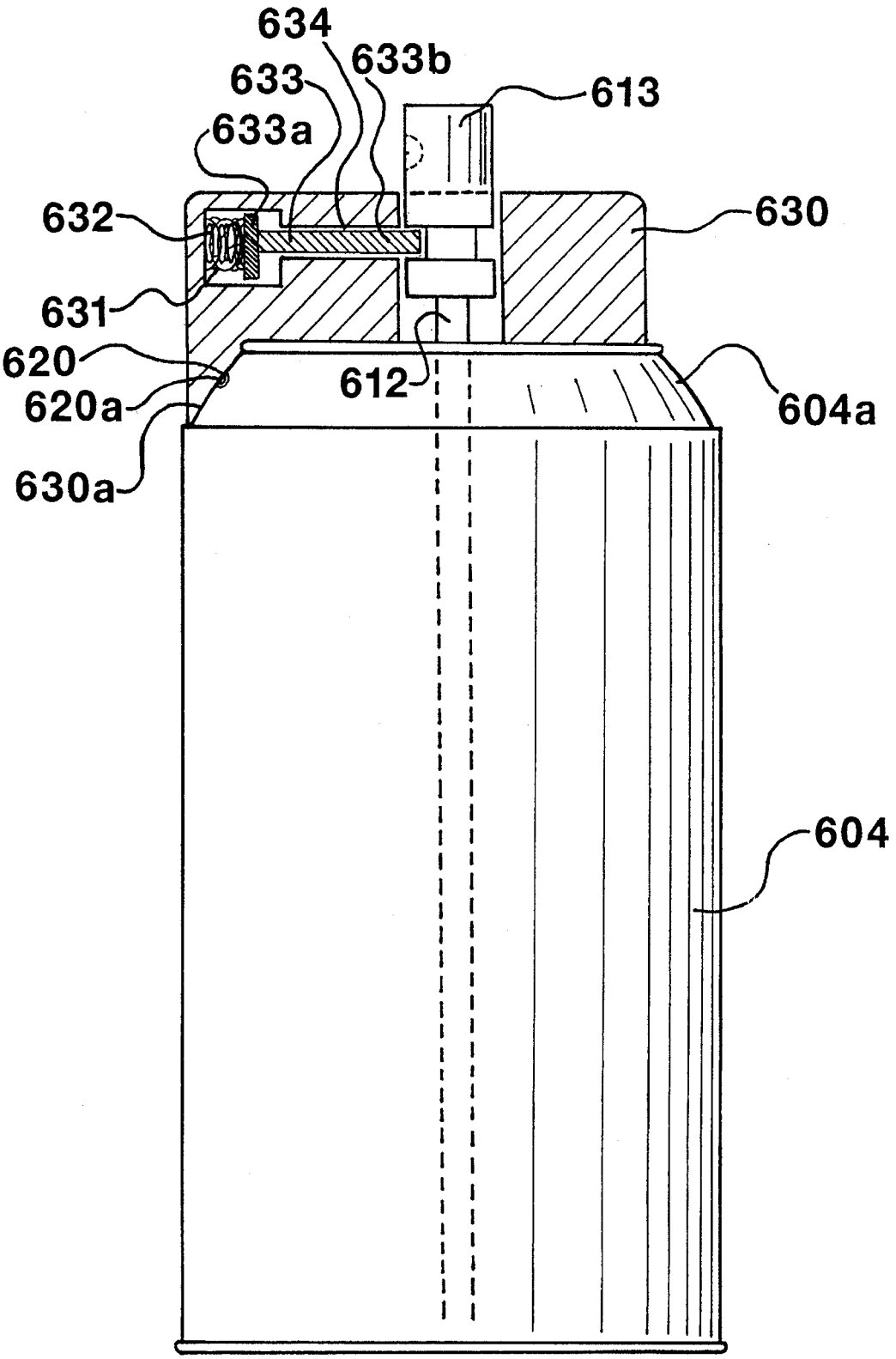
FIG. 14 is a closeup side view in partial section of a lockout collar portion of the anti-grafitti device as in FIG. 13.

As shown in a further alternate embodiment described in FIGS. 13 and 14, spray can 604 is provided with an exterior activation collar 607 with a magnetic coil therein and lockout yoke 630 surrounding shoulder 604*a* of spray can 604. FIG. 13 shows spray can 604 with activation collar 607 and lockout yoke 630. FIG. 14 shows spray can 604 with lockout yoke 630, but with activation collar 607 removed.

To use spray can 604, spray can 604 must be used with activation collar 607 attached to spray can 604, so that activation collar 607 may energize an electromagnet 605 therein for releasing finger operable outlet valve 613 from an inoperative locked position to a released position of use.

Spray can 604 is also provided with lockout yoke 630, which is attached to an upper shoulder 604*a* of spray can 604, below outlet valve 613 and above activation collar 607. Lockout yoke 630 should be installed so that any attempt to remove yoke 630 will result in the depressurization of spray can 604. Spray can 604 may therefore be manufactured with a pin hole 620 in upper shoulder 604*a* thereof with a gasket seal 620*a* provided around an outer edge of pinhole 620.

Pin hole 620 is provided in upper shoulder 604*a* of spray can 604 at a position beneath inner surface 630*a* of lockout yoke 630, so that if lockout yoke 630 is tampered with and removed, spray can 604 will be depressurized at pinhole 620.

Lockout yoke 630 includes an inner counterbore chamber 631 having a return coil spring 632 and flange 633*a* of spring loaded metallic locking pin 633. Stem 633*b* of locking pin 633 is provided within further counterbore 634, so that locking pin 633 engages under finger operable valve 613, to prevent downward movement of finger operable valve 613, and therefore to prevent fluid, such as spray paint, to enter delivery tube 612.

To use spray can 604 in an authorized manner, electromagnet 605 is activated by power through power cord 611, so that metallic locking pin 633 is responsive to a magnetic field generated at magnetic core 605*a* by magnetic coil 605*b* within electromagnet 605. As metallic locking pin 633 is attracted to electromagnet 605, locking pin 633 withdraws away from below finger operable outlet valve 613, thus freeing finger operable outlet valve to be depressed for allowing fluid, such as spray paint, to enter delivery tube 612 and exit out through finger operable outlet valve 613.

Any attempt to remove lockout yoke 630 will result in the breaking-off of the valve 613. Therefore spray can 604 itself has a means to depressurize itself, such as pin hole 620 with a sealing means, or a puncturing means not shown attached to an inner surface of collar 607 to produce an alternate pin hole not shown, when the interlocking collar 607 is tampered with.

Outlet valve 613 is made of a suitably brittle material so as to undergo disintegration upon application of force different in nature from and/or in excess of intended user finger pressure.

In the embodiments shown in FIGS. 1–6, FIG. 7, FIGS. 9–11 and FIG. 12, for a spray can 4, 104, 404 or 504 being provided insertable within respective activation bases 7, 107, 407 or 507, wherein the locking components are internal to respective spray cans 4, 104, 404 or 504, there is no need for a means for self inactivation, as is needed with the embodiment shown in FIG. 13, with an external interlocking collar 607.

Other modifications may be made to the present invention without departing from the spirit and scope of the present invention, as noted in the appended claims.

I claim:

1. A spray can with an activation base for selectively interrupting and/or controlling the dispensing of can contents comprising:

an activation base having an electromagnet operated by electric current and a recess for receiving the spray can; and where, said spray can has a liquid delivery tube for conducting liquid to be dispensed to an outlet; and further where, said spray can has a bottom member, said bottom member being made of a suitable non-magnetic material, said spray can having an interruption means for selectively impeding liquid flow through said liquid delivery tube of said spray can.

2. The device of claim 1 wherein the electric current is conventional household current.

3. The device of claim 2 where the conventional household current is 110 Volt 60 cycle alternating current.

4. The device of claim 2 where the conventional household current is 220 volt current.

5. The device of claim 1 further where said liquid flow interruption means comprises a valve disposed inside said spray can and which said valve moves between an open position and a closed position.

6. The device of claim 1 wherein said valve comprises a metallic spring plate contiguous with a plunger, said plunger being removably adjacent to an intake opening of a delivery tube within said spray can, said delivery tube communicating with a finger operable outlet means on said spray can, said metallic spring plate responsive to an electromagnet within said activation base for urging said plunger away from said intake opening of said delivery tube of said spray can for permitting flow of liquid therethrough.

7. The device of claim 6 wherein said activation base is provided with means for securely retaining said spray can within the activation base recess.

8. The device of claim 6 further comprising said activation base being further provided with an electrical supply cord connectable to a source of electric current.

9. The device of claim 7 wherein the means for securely retaining the spray can is a locking screw.

10. The device of claim 6 wherein said spring plate and said plunger are contiguous, and wherein a portion of said spring plate is made of a suitable magnetic material.

11. An anti-grafitti device comprising a spray can having a liquid delivery tube attachable to an activation base having an electromagnet, said spray can retaining a liquid flow interruption means, said liquid flow interruption means being disposed within said spray can near and/or substantially upon the spray can bottom member; and said liquid flow interruption means including a spring plate contiguous with a plunger;

said flow interruption valve spring plate further being movably retained within said spray can wherein said spring plate urges the flow interruption valve into the closed position; and further wherein a pilot extension member is attached to said plunger and said pilot member is inserted within said spray can liquid delivery tube and said pilot member is slidably moving within said delivery tube, said pilot member guiding said plunger into a partial contact with said delivery tube when said flow interruption valve is in the closed position; and further where said electromagnet is disposed in an effective positional relationship to said spring plate so as to selectively and magnetically draw said spring plate in a motion against a resistance of said spring plate and thereby move said flow interruption valve between said closed position and said open position.

12. The device of claim 6 where said flow interruption means comprises said plunger, a bumper, a pilot member and said spring plate , said plunger, bumper and pilot member being contiguous to said spring plate and further being comprised of a suitable plastic material; wherein further said pilot member is inserted into and moves slidably within said spray can delivery tube and further guides said plunger into contact with said delivery tube when said flow interruption valve moves from the open to the closed position; and further where said spring plate is comprised of a suitable magnetic material, said spring plate urging said plunger into contact with said delivery tube of said spray can; and further where said bumper is disposed between said spring plate and a bottom of said spray can so as to cushion impact therebetween.

13. The device of claim 10 where said plunger comprises a plastic cone for insertion into and contacting with said spray can liquid delivery tube; and said spring plate is comprised of spring steel affixed near and/or substantially upon the bottom member of the spray can.

14. A spray can with an activation collar for selectively interrupting and/or controlling the dispensing of can contents comprising:

an activation collar disposed on said spray can exterior, said activation collar having an electromagnet operated by electric current and means to prevent tampering with said activation collar; and where said spray can has a dispensing valve operated by pressure from the finger of a user, wherein finger pressure causes said valve to move from a closed to an open position for dispensing fluid therethrough; and further where said spray can has an interruption means for selectively preventing dispensing of said liquid, wherein the electric current is conventional household current and, where the liquid flow interruption means comprises a locking yoke disposed adjacent to said activation collar for selectively locking said finger pressure dispensing valve of said spray can in the closed position.

15. The device of claim 14 wherein the electric current is conventional household current.

16. The device of claim 15 where the conventional household current is 110 Volt 60 cycle alternating current.

17. The device of claim 14 wherein the electric current is conventional household current.

18. The device of claim 14 wherein the activation collar locking yoke further comprises a movable lock member comprised of a suitable magnetic material wherein said lock member is capable of moving between a locked and an unlocked position; said locking yoke further comprising a spring responsive to an adjacent electromagnet, such that said spring urges said lock member into the locked position wherein said finger pressure dispensing valve of said spray can is thereby locked in the closed position; and further wherein said electromagnet is disposed so as to be capable of drawing said lock member in a motion against the urging of said spring, said electromagnet thus providing a magnetic force for moving said lock member into its unlocked position and maintaining it there; and wherein said activation collar is further provided with an electrical supply cord.

19. The device of claim 18 wherein the tamper prevention means of said activation collar comprises a pinhole in said spray can having a flexible sealing gasket therearound; the gasket being unfixed and free to become dislodged; and further wherein said gasket is held in sealing disposition over said spray can pinhole by effective contact with said activation collar.

20. The device of claim 14 wherein the tamper prevention means further comprises said finger pressure spray can dispensing valve being comprised of a suitably brittle material so as to undergo disintegration upon application of force different in nature from and/or in excess of intended user finger pressure against said valve.

* * * * *

Adverse Decision In Interference

Patent No. 5,603,433, Albert Rene, ANTI-GRAFFITI SECURITY DEVICE FOR AEROSOL DISPENSER CANS, Interference No. 104,634, final judgment adverse to the patentee rendered June 7, 2001, as to claims 1-5.

*(Official Gazette July 10, 2001)*